United States Patent [19]

Jones

[11] Patent Number: 5,073,061

[45] **Date of Patent: * Dec. 17, 1991**

[54] INDUSTRIAL RESTRAINT EDGING SYSTEM FOR SEGMENTED PAVING UNITS

[76] Inventor: Stephen Jones, 10800 Morris Ave., South Bloomington, Minn. 55437

[ * ] Notice: The portion of the term of this patent subsequent to Sep. 5, 2006 has been disclaimed.

[21] Appl. No.: 509,173

[22] Filed: Apr. 16, 1990

[51] Int. Cl.[5] ..... E01C 11/22

[52] U.S. Cl. ..... 404/7; 404/8

[58] Field of Search ..... 404/7, 8, 34, 40, 43; 47/33

[56] References Cited

U.S. PATENT DOCUMENTS 3,520,082 7/1970 Smith ..... 404/7 X
4,863,307 9/1989 Jones ..... 404/7

FOREIGN PATENT DOCUMENTS 19876 of 1910 Norway ..... 404/7
688163 2/1953 United Kingdom ..... 404/8

*Primary Examiner*—William P. Neuder
*Attorney, Agent, or Firm*—Evenson, Wands, Edwards, Lenahan & McKeown

[57] ABSTRACT

Paving support apparatus is provided which includes substantially vertical strip restraining elements for defining a boundary around paving members and the like which move laterally during use. The support apparatus is disposed below local ground level during use. The vertical strip restraining elements include an inner surface facing toward the paving member for receiving substantially horizontal forces. Horizontal extension elements are provided which extend out from an outer surface of the vertical strip restraining elements in at least the lower region of the upright strip restraining elements for receiving vertical forces relative to the ground surface. Force converting or reinforcing elements are provided for converting the horizontal forces received by the vertical strip restraining elements into vertical forces against the horizontal extension elements, thereby restraining the paving members in the boundary. The horizontal extension elements extend inwardly of the boundary to underlie the paving members and accept vertical forces to thereby clamp the support apparatus and resist horizontal movement thereof. Preferred embodiments include unitary molded plastic support members exhibiting substantially planar upright member portions engageable with paving members, a substantially lower base member portion extending from both sides of the upright member portion by a substantial distance and a reinforced member portion connecting the upright member portion and the base member portion.

86 Claims, 4 Drawing Sheets

INDUSTRIAL RESTRAINT EDGING SYSTEM FOR SEGMENTED PAVING UNITS

BACKGROUND AND SUMMARY OF THE INVENTION

The present invention relates to an edging restraint system for maintaining segmented paving units within a predetermined boundary.

In recent years, there has been an increasing use of segmented paving units such as paving stones and paving bricks for forming sidewalks, driveways, industrial and commercial pavements, and road surfaces. Due to the large variation in color and shape configurations available with paving stones and the like, coupled with their extremely hard traffic bearing characteristics, the use of such paving stones is quite advantageous with respect to the variations and flexibility that one can apply in landscaping projects and the like.

My U.S. Pat. No. 4,863,307, issued Sept. 5, 1989, relates to a paving stone restraint system which has met with substantial commercial acceptance due to its simplicity of construction and reliability and simplicity of installation to hold segmented paving units, such as paving stones and paving bricks in place. The present invention is directed toward improving on this restraint system, and more particularly on providing for a more rugged and durable restraint system for use in industrial/commercial settings where extremely high forces are applied to the paving surfaces and edge restraint members. The present invention is also directed toward improving side force resistance characteristics of the restraint system. Throughout this specification, preferred embodiments for restraining paving stones are described. It will be understood by those skilled in the art that many aspects of the restraint systems can also be applied to restrain other segmented paving units, such as paving bricks, paving blocks of wood, and the like.

According to especially preferred embodiments of the present invention, an edging system is provided which includes a vertical strip which has a side surface that faces and restrains the paving stones and a horizontal base which is connected to the vertical strip to hold the same in position. The horizontal base of preferred embodiments of the present invention includes a paving stone supporting extension which protrudes substantially under the paving stones, such that vertical forces acting on the paving stones are transmitted via the sand or other paving stone bedding to clamp this paving stone support extension against lateral outward movement.

In certain preferred embodiments, the horizontal base also extends laterally outward of the vertical restraint surface which engages the paving stones and is anchored in position in the soil/base by means of anchoring spikes. In certain preferred embodiment, holes can be provided in the horizontal base support surface at both the outwardly protruding portion and at the inwardly protruding stone supporting portion, thereby providing for a very firm, strong anchoring of the restraint edge system.

In especially preferred embodiments, the vertical strip and the horizontal base are connected together as a unitary extruded plastic piece. This extruded plastic configuration has a constant cross section so that indeterminate lengths can be economically extruded, the same being then cut to length as desired to accommodate shipment and installation. Since one needs only to drill holes for the anchoring spikes to have a ready to use restraint system that can be easily transported to the paving stone installation site, this type of configuration is very practical and economical.

Other preferred embodiments are contemplated which are manufactured by other manufacturing processes such as blow molding of plastic and injection molding of plastic. These processes allow for variation in the cross-section along the length of the restraint system to accommodate savings of plastic and to accommodate special shape configurations that vary along the system length.

In order to even further enhance the resistance of the restraint edge system to lateral movements, certain preferred embodiments include ribs or other gripping protrusions at the bottom of the horizontal base for biting into the underlying soil/base to further prevent side slippage in the event of lateral forces on the paving stones. In especially advantageous embodiments where the vertical restraint and the horizontal base are extruded together, these protrusions are also extruded as longitudinally extending ribs of the restraint edge. Thus, a restraint system is obtained in a simple manner which is very firmly anchorable in position, with the (i) gripping protrusions, (ii) the spikes and (iii) the paving stone underlying support extension all serving separately and also cooperating to provide for a very reliable firm maintenance of the paving stones in position, even in the event of extremely large industrial vehicles travelling along the boundary edges of the paving surface comprised of paving stones.

In certain preferred embodiments, the anchoring spike holes in the paving stone underlying extension are offset in the longitudinal direction of the restraint edge with respect to the anchoring spike holes in the outwardly protruding horizontal base section, thereby providing for a reliable anchoring, without unduly weakening the plastic restraint edge system. This offset arrangement enhances the anchoring effect of the spikes by providing multidirectional anchoring resistance forces from a plurality of spikes during use with vehicle traveling loads moving along the edge of the paving surface.

In certain preferred embodiments, the restraint edging system includes reinforcing connections between the vertical restraining and the outwardly protruding horizontal base portion, thereby further strengthening the restraint edge system. In certain preferred embodiments, the reinforcing is also formed as a continuous longitudinal extrusion s that the complete restraining edge strip can be made as a single continuous piece by simple extrusion molding operations.

In certain preferred embodiments, reinforcing fillets are provided at the inside corner between the vertical restraining portion and the horizontal stone support portion. Such reinforcing fillets are especially advantageous in embodiments which do not have an outwardly extending base section.

In other preferred embodiments formed by other manufacturing processes, such as injection or blow molding processes, the reinforcing is in the form of discrete reinforcements spaced along the length of the restraint system.

Other objects, advantages and novel features of the present invention will become apparent from the following detailed description of the invention when considered in conjunction with the accompanying drawings.

DETAILED DESCRIPTION OF THE DRAWINGS

Figure 1:
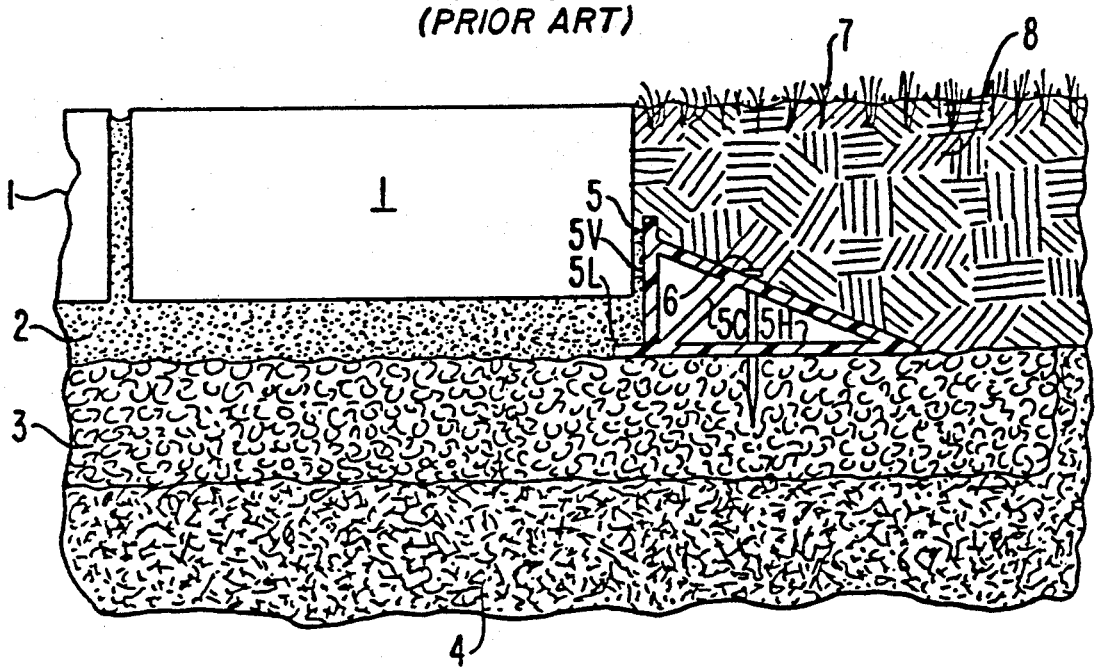
FIG. 1 (PRIOR ART)
FIG. 1 is a cross section schematic view depicting a prior art edge restraint system.

Referring to the FIG. 1 prior art arrangement, it is noted that the same corresponds to the commercially available Pave Edge TM edging marketed by Pave Tech, Inc. of Minneapolis, Minn. This prior art arrangement also corresponds to my above-mentioned U.S. Pat. No. 4,863,307.

Referring to FIG. 1, paving stones or pavers 1 are placed on a layer of sand 2, with an aggregate base 3 and a compacted subbase 4 underlying the sand layer. The edging 5 is formed as an extruded plastic strip which has a vertical restraining strip portion 5V facing the paving stone 1 and a horizontal extension 5H which extends from the bottom of the vertical strip 5V outwardly away from the paving stones 1. A short lip 5L protrudes from the bottom of the strip 5V in a direction toward the paving stones 1. Reinforcing connections 5C interconnect the horizontal base 5H and the vertical strip 5V.

At spaced intervals along the length of the restraining strip 5, anchoring spikes 6 are driven into the compact base and/or soil 3 and serve together with the configuration of the plastic restraining strip to hold the same against horizontal movements transmitted through the paving stones 1. Once the restraining strip 5 is in position for holding the paving stones 1, back fill including black dirt 8, and turf 7 in the form of sod or grass, can be applied to the top thereof to conceal the restraint system and provide an aesthetically pleasing transition between the outside row of paving stones 1 and the adjacent landscape.

Figure 2:
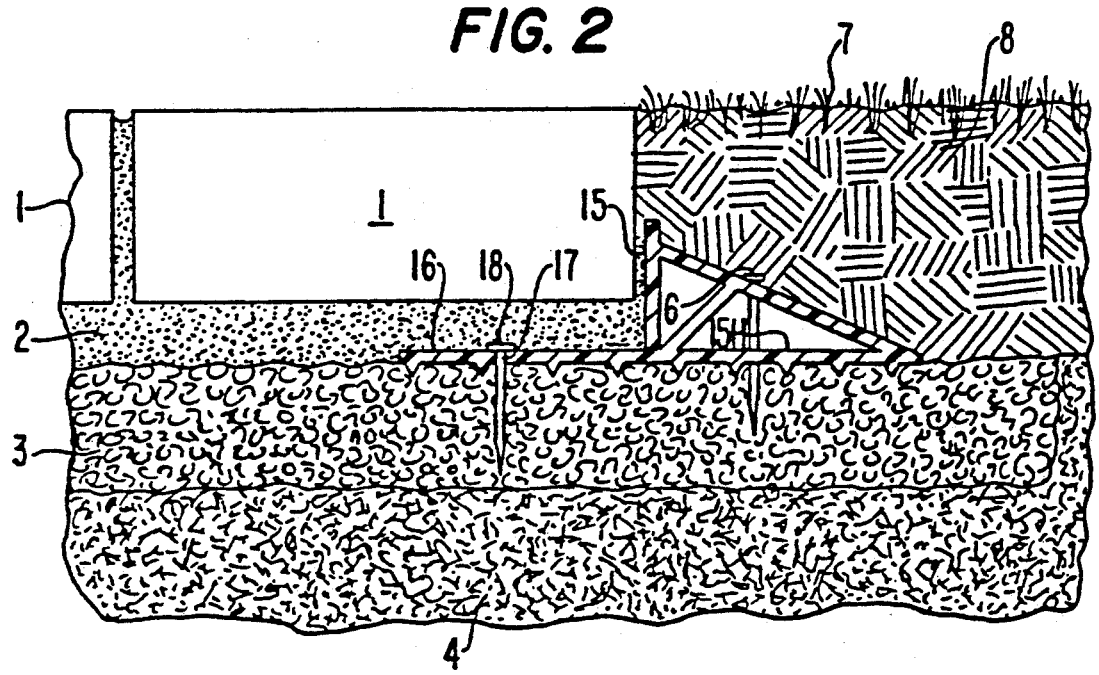
FIG. 2 is a view similar to FIG. 1, depicting a first preferred embodiment of the present invention.

FIG. 2 depicts a preferred embodiment of the present invention and includes corresponding reference numerals as FIG. 1 for the corresponding structure of the paving stones 1, sand 2, compact base 3, compacted subbase 4, spike 6, turf 7 and black dirt 8. Thus, these features will not be repetitively described in conjunction with this FIG. 2, reference being made to the FIG. 1 description.

The embodiment of the present invention according to FIG. 2 differs from the prior art of FIG. 1 in several important aspects to be described as follows. A restraint stone support extension 16 is provided which is formed as a continuation of the horizontal base 15H extending outwardly of the paving stones 1. The support extension 16 includes preformed or drilled apertures 17 for spikes 18 which assist in holding the restraint member 15 in position. As can best be seen in FIG. 4, the holes 6H for the spikes 6 are offset in the longitudinal direction of the edging member 15 with respect to the holes 17 for the spikes 18. This offset pattern provides for a firm reliable connection of the restraint member 15 to the ground surface, while minimizing localized weaknesses that might otherwise be caused if the holes 6H and 17 were immediately opposite one another.

Figure 3:
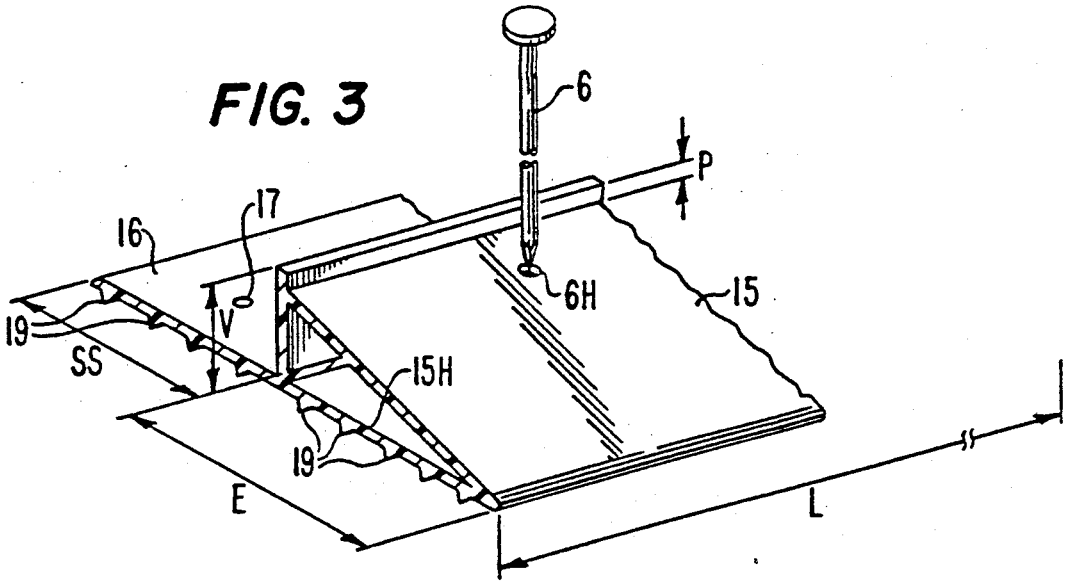
FIG. 3 is a perspective view of a section of the edge restraint system of FIG. 2.
Figure 4:
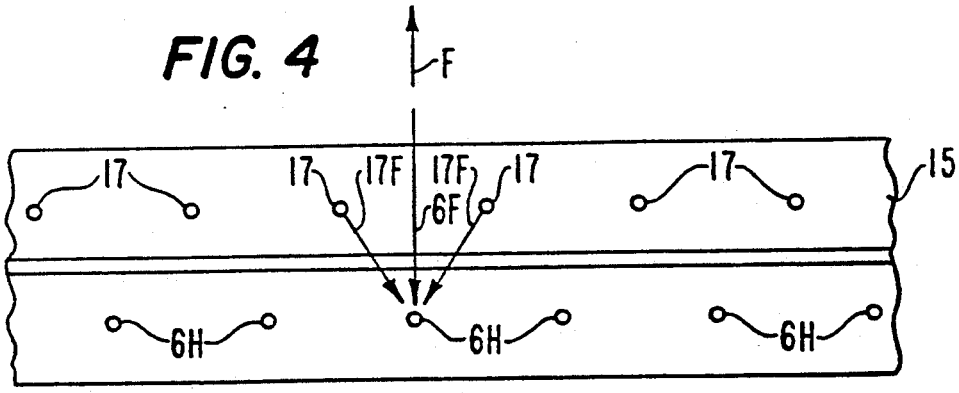
FIG. 4 is a top view of the edge restraint strip of FIGS. 2 and 3, depicting the anchoring spike hole configuration.
Figure 4A:
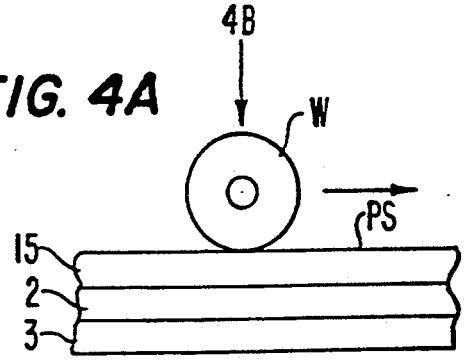
FIG. 4A is a schematic side view of the edge restraint strip and paving surface with a vehicle wheel traveling thereover.
Figure 4B:
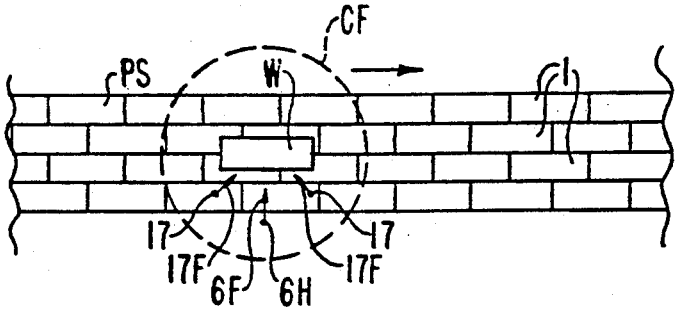
FIG. 4B is a schematic top view taken in the direction of arrow IVB of FIG. 4A, schematically depicting the forces acting on the edge restraint system during use with a vehicle wheel traveling thereover.

FIGS. 4, 4A and 4B schematically depict the force loading experienced in use with the edge restraint system of FIGS. 2–4. Schematically depicted vehicle wheel W is shown traveling adjacent the edge of the paving surface PS, made up of the paving stones 1. As the vehicle wheel travels in the direction depicted by the horizontal arrow going to the right, a circle of force CF is experienced and transferred through the paving surface, such circle of force CF having a diameter of about 3 feet from the center point of the engagement of the wheel W at the paving surface. Thus, the paving stones, and the consequent underlying edge restraint system, experiences a dynamic change in force field tending to push the edging laterally. The arrows 6F and 17F in FIGS. 4 and 4B indicate the resistance exerted by the respective spikes using the edge restraint system of the FIGS. 2–4, where it can be seen that when the wheel W is directly across from a hole 6H, the spikes in the hole 6H and in the holes 17F exert a combination of resistance forces to resist the lateral movement of the edge restraint system. In FIG. 4, the forces 6F and 17F are depicted in the direction of action on the restraint member 15 and in FIG. 4B in the reaction or resistance direction. In use, the paving surface may experience much vehicle traffic. Each time a vehicle travels adjacent the edge it exerts a moving force field against the edge restraint system. The combination of two rows of mutually offset anchoring holes and spikes is particularly advantageous in accommodating these multiple loadings while maintaining a reliable holding of the restraint edge member in position.

Although the preferred embodiment illustrated indicates predrilled holes 17 and 6H in the edge restraint member, other embodiments are contemplated wherein the members are not predrilled, but are formed of such a thickness and constituency that they can accommodate the application of anchoring spikes therethrough. In other preferred embodiments with injection or blow molding, or other suitable manufacturing operations, weakened locations for the anchoring spikes could be provided. In other alternative embodiments, the material and thickness of the edge restraint member are such that driving of anchoring spikes therethrough will not destroy the same.

To further assist in anchoring the edge restraint member 15 against lateral movement, anchoring ribs 19 are formed along the underside of the support extension 16 and the horizontal outward extension 15H. In especially preferred embodiments, these anchoring ribs 19 are formed together with the remainder of the restraint edge member 15 as a plastic extruded profile part, the ribs 19 extending in a longitudinal direction of the member 15. This configuration facilitates the easy manufacture thereof by extrusion processes, while also orienting the ribs in the optimum direction vis-a-vis the lateral forces experienced in use in supporting paving stones 1.

According to other contemplated embodiments of the invention, the anchoring ribs 19 can be replaced by other gripping protrusions such as discrete knobs that can be formed at the underside of the members 15. Especially in embodiments formed by injection or blow molding techniques, the provision of discrete gripping protrusions can be done during the manufacture of the parts.

The improved edge restraint system of FIGS. 2–4 provides for an enhancement of the anchoring and lateral support of the restraint system in three different ways, which operate together and separately, to provide for a very reliable rugged installation. First, the extension 16 protrudes sufficiently under the paving stones 1 through the bedding course 2 to assure substantial force transfer from the stones 1 to the member 16 to thereby clamp the same against the compact base surface 3. Second, the anchoring ribs 19 dig into the ground surface to further resist lateral sliding movements away from the paving stones. Thirdly, the provision of anchoring stakes 18 through the holes 17, in addition to the anchoring stakes 6 through holes 6H, further assures reliable anchoring of the restraint system.

Preferred embodiments are contemplated which include pre-formed strips 15, with holes 17 and 6H predrilled in a predetermined pattern. Thus, the plastic strips can be carried to a construction site and be easily applied to hold the paving stones in position. Other embodiments are contemplated wherein the base of the restraining strip 15 is formed with an open lattice structure, the openings in the lattice structure being available to accommodate the insertion of the anchoring spikes.

Referring to FIG. 2, dimensional ranges for a preferred embodiment of a unitary plastic restraining edging member are dependent upon the dimensions of the paving stones being supported. In most commercial and other installations contemplated by the invention, the paving stones would have a vertical dimension in the range of 1½ inches to 6 inches. The recommended installation procedures provide that the vertical restraint edge extend upward from the base 3 by an amount equivalent to one-third height to the full vertical height of the paving stone. Thus for the typical installation, the dimension V would be in the range of 1½ to 4 inches, with 2 inches being typical for conventional paving stones 1 having a vertical height of 2 inches and with a 1 inch layer of sand 2. The portion P extending above the reinforcement section is preferably in the range of one-half inch to an inch. The horizontal stone support extension 16 extends a distance SS from the vertical restraint surface which is preferably at least ½" so as to assure the clamping effect described herein. In especially preferred embodiments, the horizontal stone support extension dimension SS is in a range of ½" to 6" with a range of 1½" to 6" being provided for especially preferred embodiments. The outward horizontal extension 15H has a width E of approximately the same size as the dimension SS.

The individual ribs 19 preferably protrude downwardly between 1/32 and ¼ of an inch and exhibit an equilateral triangular shape with one triangle point facing downwardly. Preferably at least two ribs 19 are provided on the stone support extension 16. The horizontal outwardly extending section 15H can also be provided with ribs 19 in certain embodiments. The holes H and 17 for the anchoring spikes should permit anchoring with ¼" to ⅜" anchoring spikes or larger, the spikes being at least six inches long for most base surfaces. The individual pieces of the restraint member 15 are to be cut to lengths so that they can be easily transported and installed. In especially preferred arrangements, this length L is in the range of 6 to 20 feet.

Each of the members or sections 15H, 16, 15V preferably have a thickness of between ⅛" and ⅜" when recycled plastic is used. The particular thickness will depend on the material and should provide for accommodating limited flexibility to abut against curved and slightly irregular paving unit edges, such as for curved roadways and the like.

Embodiments similar to the embodiments of FIGS. 1 to 4 are also contemplated which provide for more flexibility by having shorter sections coupled together, such as those disclosed in my above-noted U.S. Pat. No. 4,863,307, with appropriate connection pieces provided as suggested in that patent. To accommodate the stone support extension 16 in these embodiments, appropriate sections of same should be cut out to accommodate bending of the members around curves.

Figure 5:
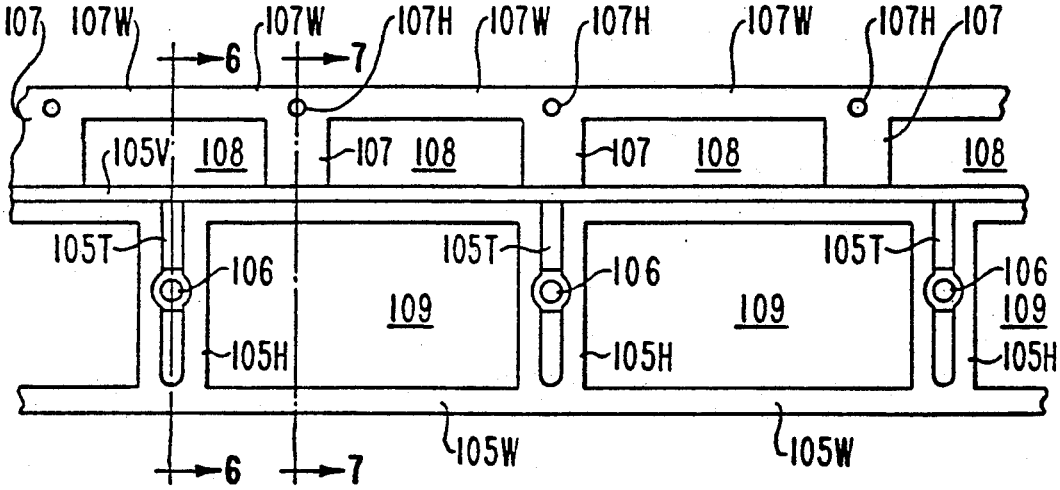
FIG. 5 is a top view of an edge restraint strip, constructed according to a second preferred embodiment of the invention.
Figure 6:
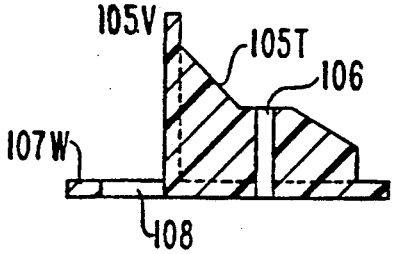
FIG. 6 is a sectional view of the restraint strip of FIG. 5, taken along sectional line 6—6 of FIG. 5.
Figure 7:
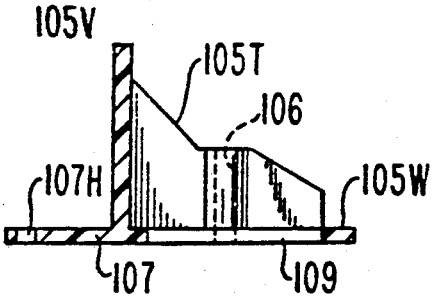
FIG. 7 is a sectional view of the restraint strip of FIG. 5, taken along sectional line 7—7 of FIG. 5.

The embodiment of FIGS. 5 to 7 utilizes an injection molded or blow molded construction which has a discontinuous cross section along its length. In this embodiment, the parts shown are also constructed as a unitary plastic piece, which includes a vertical restraining strip portion 105V which will face the paving stones in the in-use position. A plurality of horizontal extensions 105H extend horizontally away from the vertical restraint surface portion 105V and are connected together by a horizontal extension connecting web 105W. This construction provides for force conversion similar to the embodiment of FIGS. 2–4. Substantially triangularly shaped reinforcement sections 105T are provided at the mid points of the extensions 105H. These reinforcing sections 105T are integrally connected at both the horizontal extension 105H and the back side of the vertical restraint wall portion 105V. These reinforcing parts 105T are also provided with anchoring holes 106 for accommodating anchoring spikes.

According to other preferred embodiments, the reinforcing sections 105T are constructed with different angular inclination with respect to the vertical wall portion 105V. According to other preferred embodiments, reinforcing sections 105T having rectangular or rectangular stepped shape are provided. In embodiments with reinforcing sections 105T, these sections should be configured to transfer forces between the wall portion 105V and horizontal extension 105H, and via the extension 105H, to the compact base 3.

Protruding from the opposite side of the vertical restraining part 105V are a plurality of stone support sections 107 which are interconnected at their outer ends by interconnecting web 107W which extends along and parallel to the vertical restraint wall portion 105V. These stone support sections 107 are integrally connected at the bottom of the vertical restraining member 105V and each include an anchoring hole 107H for accommodating anchoring spikes. In the embodiment shown, the sections 107 and 105 are longitudinally offset from one another, with consequent offsetting of the anchoring holes 107H.

The construction of FIGS. 5 to 7 is advantageous in that the horizontal base surface includes open sections 108 at the stone support extension side and open sections 109 at the horizontal extension side of the vertical restraining member. These open sections serve to limit the amount of plastic material required, and also facilitate adjusting of the member to accommodate curves and the like by merely cutting out small sections from the respective webs 105W and 107W as required to accommodate the curving of the vertical restraint member wall portion 105V. Additionally, the embodiment of FIGS. 5 to 7 exhibits the above-discussed advantages with respect to the embodiment of FIGS. 2 to 4, insofar as enhancing the anchoring of the restraint edging member by utilizing the force of the paving stones themselves, as well as anchoring spikes at the stone side of the vertical restraining member, and in certain preferred arrangements, at both sides of the vertical restraining member.

In certain preferred embodiments according to FIGS. 5 to 7, ribs or other gripping protrusions are formed at the underside of one or both of the sets of underlying horizontal members 107 and 105H, to thereby further enhance the anchoring of the system against horizontal movement. In view of the clamping effect at the member 107, certain preferred embodiments include gripping protrusions only at the members 107, with none being provided at the members 105H. Other preferred embodiments are contemplated with gripping protrusions only at the member 105H.

Figure 8:
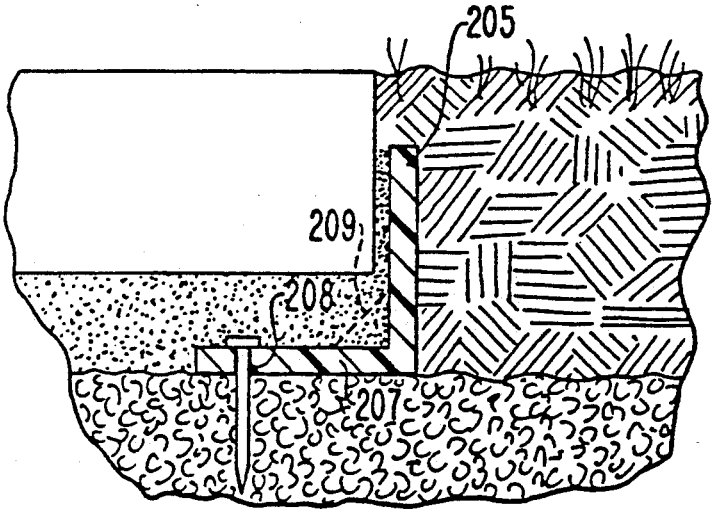
FIG. 8 is a view similar to FIG. 2, showing yet another preferred embodiment of the invention.
Figure 9:
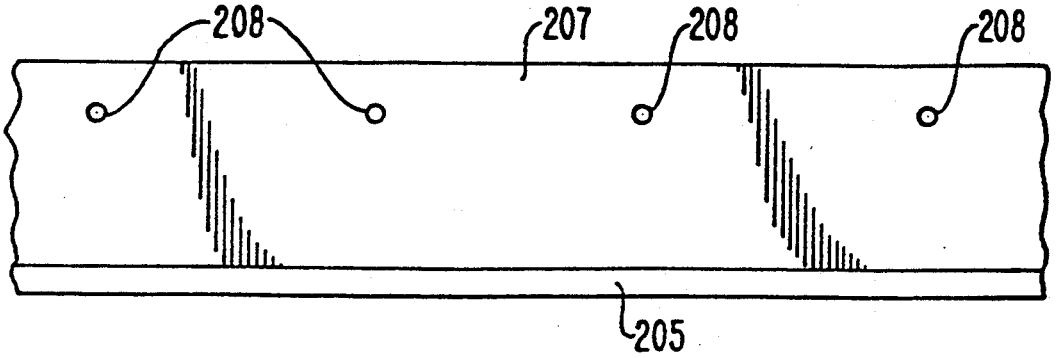
FIG. 9 is a top view of the restraining member of FIG. 8.

The embodiment of FIGS. 8 and 9 provides an especially simple construction in that a simple L-shaped piece of plastic is extruded and includes a vertical restraining wall 205 and a horizontal stone supporting section 207 integrally connected at the bottom of the wall 205. Anchoring holes 208 are disposed in the stone support extension 207. Shown in dash lines in FIG. 8 is an alternative reinforcing section 209 which can be constructed as an integral insert at the corner between the vertical section 205 and the horizontal section 207 in the matter of a fillet to reinforce the member against bending of the vertical wall 205. Since the sand layer is disposed above this reinforcement 209, which preferably has dimensions in the vertical direction no more than one-half of the expected sand layer, which is usually in the range of one to two inches, there is no interference with the operation of this simple L-shaped construction. Alternatively, if the L-shaped member is to be formed by injection molding or blow molding operations whereby discontinuous cross sections can be readily formed, the reinforcements 209 can be constructed as discrete spaced apart triangular fillets. Alternative embodiments with the reinforcements 209 having other geometric cross-sections, includes rectangular and curved fillet constructions.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A segmented paving unit restraint system for edging and restraining segmented paving units on a base surface comprising:

a substantially vertical strip restraining member for defining a boundary around said segmented paving units, said substantially vertical strip restraining member being flexibly formed to accommodate for irregular shaped boundaries around segmented paving units and having a first side surface for facing segmented paving units and receiving substantially lateral forces therefrom, a second side surface for facing away from segmented paving units, and a top surface, said top surface being disposed below local ground level, and a substantially horizontal segmented paving unit support member force lockingly connected to the vertical strip restraining member and extending horizontally inwardly from said first side surface to an inner end disposed under segmented paving units being restrained during use thereof, whereby the downward forces on segmented paving units is transferred to said segmented paving unit support member to clamp the same against an underlying base surface to restrain horizontal movements of the vertical strip restraining member resulting from the substantial lateral forces.

2. A segmented paving unit restraint system according to claim 1, wherein said vertical strip restraining member and said support member are formed as a unitary one-piece construction.

3. A segmented paving unit restraint system according to claim 2, wherein said one-piece construction has a length greater than the length of at least two paving units to be restrained thereby.

4. A segmented paving unit restraint system according to claim 3, further comprising a substantially horizontal extension member force lockingly connected to and extending horizontally outwardly from said second side surface to an outer end, said horizontal extension member being formed together with the one-piece construction.

5. A segmented paving unit restraint system according to claim 4, wherein the horizontal distance between the inner edge of the segmented paving unit support member and the vertical strip restraining member is at least half as great as the distance between the outer end of the horizontal extension member and the vertical strip restraining member.

6. A segmented paving unit restraint system according to claim 1, wherein at least a portion of the under surface of the horizontal segmented paving unit support member is provided with rib means for limiting lateral slippage on the base surface.

7. A segmented paving unit restraint system according to claim 1, wherein holes are provided in the horizontal segmented paving unit support member for accommodating anchoring spikes.

8. A segmented paving unit restraint system according to claim 1, wherein the horizontal segmented paving unit support member is configured to accommodate anchoring spikes therethrough.

9. A segmented paving unit restraint system according to claim 4, wherein holes are provided in the horizontal extension member for accommodating anchoring spikes.

10. A segmented paving unit restraint system according to claim 2, wherein the horizontal extension member is configured to accommodate anchoring spikes therethrough.

11. A segmented paving unit restraint system according to claim 9, wherein holes are provided in the horizontal segmented paving unit support member for accommodating anchoring spikes.

12. A segmented paving unit restraint system according to claim 11, wherein the holes in the horizontal extension member are offset in the longitudinal direction of the vertical strip restraining member with respect to the holes in the segmented paving unit support member.

13. A segmented paving unit restraint system according to claim 4, wherein the vertical strip restraining member, the horizontal extension member, and the horizontal segmented paving unit support member are formed together as a unitary plastic piece.

14. A segmented paving unit restraint system according to claim 13, wherein said unitary plastic piece is formed as an extruded plastic piece with a substantially constant cross section.

15. A segmented paving unit restraint system according to claim 14, wherein at least a portion of the underside of the horizontal extension member and the horizontal segmented paving unit support member are provided with longitudinally extending ribs for engaging downwardly in the base surface to limit the lateral sliding movement of the vertical strip restraining member.

16. A segmented paving unit restraint system according to claim 15, wherein said ribs include a plurality of ribs in each of the horizontal segmented paving unit support member and the horizontal extension member.

17. A segmented paving unit restraint system according to claim 15, wherein the ribs are formed together with the unitary plastic piece.

18. A segmented paving unit restraint system according to claim 14, wherein said ribs are also formed as continuous longitudinally extending protrusions at the underside of the restraint edging member.

19. A segmented paving unit restraint system according to claim 1, wherein said horizontal segmented paving unit support member is at least $\frac{1}{3}$ as wide as the narrowest horizontal width of segmented paving units to be supported thereby.

20. A segmented paving unit restraint system according to claim 1, wherein said horizontal segmented paving unit support member is wider than the narrowest width of segmented paving units to be supported thereby.

21. A segmented paving unit restraint system according to claim 1, wherein said horizontal segmented paving unit support member is wider than the height of said vertical strip restraining member.

22. A segmented paving unit restraint system according to claim 1, wherein said horizontal segmented paving unit support member is integral with said vertical strip restraining member and extends at least 1" inwardly from a lower part of said first surface.

23. A segmented paving unit restraint system according to claim 1, wherein said horizontal segmented paving unit support member is integral with said vertical strip restraining member and extends at least 3" inwardly from said lower part of said first surface.

24. A segmented paving unit restraint system according to claim 16, wherein said horizontal segmented paving unit support member is wider than the narrowest width of segmented paving units to be supported thereby.

25. A segmented paving unit restraint system according to claim 16, wherein said horizontal segmented paving unit support member is wider than the height of said vertical strip restraining member.

26. A segmented paving unit restraint system according to claim 25, wherein at least one of said ribs are provided in each of said horizontal extension member and said horizontal paving unit support member.

27. A segmented paving unit restraint system according to claim 1, wherein the vertical stone support member and the horizontal paving unit support member are formed together as a unitary piece each having a length of more than two feet.

28. A segmented paving unit restraint system according to claim 27, wherein said unitary piece is a plastic piece.

29. A segmented paving unit restraint system according to claim 28, wherein said unitary plastic piece is formed as an extruded piece with a substantially constant cross-section.

30. A segmented paving unit restraint system according to claim 28, wherein said unitary plastic piece is formed as an injection molded piece.

31. A segmented paving unit restraint system according to claim 28, wherein said unitary plastic piece is formed as a blow molded piece.

32. A segmented paving unit restraint system according to claim 1, wherein said horizontal paving unit support member includes a plurality of spaced apart horizontally extending paving unit support parts integrally connected to the lower edge of the vertical restraint member.

33. A segmented paving unit restraint system according to claim 32, wherein the spaced apart paving unit support parts are connected at their most inward ends by a paving unit support web member extending parallel to the vertical restraint member.

34. A segmented paving unit restraint system according to claim 2, wherein the horizontal extension member includes a plurality of spaced apart horizontally extending extension parts integrally connected to the vertical restraint member.

35. A segmented paving unit restraint system according to claim 34, wherein the spaced apart extension parts are connected at their most outward ends by an extension web member extending parallel to the vertical restraint member.

36. A segmented paving unit restraint system according to claim 34, wherein the horizontal extension member includes a plurality of spaced apart horizontally extending extension parts integrally connected to the lower edge of the vertical restraint member.

37. A segmented paving unit restraint system according to claim 36, wherein the spaced apart paving unit support parts are connected at their most inward ends by paving unit support webs extending parallel to the vertical restraint member.

38. A segmented paving unit restraint system according to claim 37, wherein the spaced apart extension parts are connected at their most outward ends by extension webs extending parallel to the vertical restraint member.

39. A segmented paving unit restraint system for edging and restraining segmented paving units on a base surface comprising:

a substantially vertical strip restraining member for defining a boundary around said segmented paving units, said substantially vertical strip restraining member being flexibly formed to accommodate for irregular shaped boundaries around segmented paving units and including a first side surface for facing said segmented paving units and receiving substantially lateral forces therefrom, a second side surface facing away from said segmented paving units, and a top surface, said top surface being disposed below local ground level;

a horizontal base member force lockingly connected to the vertical strip restraining member and having a downwardly facing support surface for resting on the base surface, and gripping means at the downwardly facing support surface for extending downwardly from the horizontal base surface for engaging in said base surface and preventing lateral slippage of the edge restraint system from the substantial lateral forces.

40. A segmented paving unit restraint system according to claim 39, wherein said gripping means are rib means.

41. A segmented paving unit restraint system according to claim 40, wherein said vertical strip restraining member and horizontal base member are formed as a unitary one piece plastic part including said rib means.

42. A segmented paving unit restraint system according to claim 40, wherein said rib means includes a plurality of spaced apart ribs extending longitudinally of the horizontal base member.

43. A segmented paving unit restraint system according to claim 40, wherein said rib means includes a plurality of discrete ribs spaced from one another in a longitudinal direction of the horizontal base member.

44. A segmented paving unit restraint system according to claim 40, wherein anchoring holes are provided in said horizontal base member for accommodating anchoring spikes.

45. A segmented paving unit restraint system according to claim 44, wherein said rib member includes annular ribs surrounding said holes.

46. A paving edge restraint system for edging and restraining segmented paving units at a base surface comprising:

substantially vertical strip restraining means for defining a boundary around said segmented paving units, said substantially vertical strip restraining means being flexibly formed to accommodate for irregular shaped boundaries around segmented paving units and including a first side surface for facing said segmented paving units and receiving substantially lateral forces therefrom, a second side surface facing away from said segmented paving units, and a top surface, said top surface being disposed below local round level, substantially horizontal segmented paving unit support means extending horizontally inward from a lower part of said first side surface to an inner end disposed under segmented paving units to be restrained during use thereof, and means provided in said horizontal segmented paving unit support member for accommodating anchoring stakes for holding the same in position on the base surface.

47. A paving edge restraint system according to claim 46, wherein said means for accommodating anchoring stakes include preformed holes.

48. A segmented paving unit restraint system for edging and restraining segmented paving units on a base surface comprising:

a substantially vertical strip restraining member for defining a boundary around said segmented paving units, said substantially vertical strip restraining member being flexibly formed to accommodate for irregular shaped boundaries around segmented paving units and including a first side surface for facing said segmented paving units and receiving substantially lateral forces therefrom, a second side surface facing away from said segmented paving units, and a top surface, said top surface being disposed below local ground level;

a horizontal base member force lockingly connected to the vertical strip restraining member and having a downwardly facing support surface for resting on the base surface, and anchoring stake accommodating means provided in said horizontal base member for accommodating anchoring stakes for holding the same in position on the base surface, said anchoring stake accommodating means being arranged in a plurality of rows, with the stake accommodating means in one row being offset longitudinally of the vertical strip restraining member with respect to the stake accommodating means in another of said rows.

49. A system according to claim 48, wherein two of said rows of stake accommodating means are provided in said horizontal base means.

50. A system according to claim 49, wherein said vertical strip restraining member and horizontal base member are formed together as an integral plastic member.

51. A system according to claim 50, wherein said stake accommodating means are preformed holes through the horizontal base member.

52. A system according to claim 50, wherein said stake accommodating means are predetermined weakened parts in the horizontal base member.

53. A paving installation including means for restraining lateral edges of paving surface means for accommodating traffic which in use experiences substantial horizontal forces at its lateral edges and which is located on top of a substantially level base surface disposed below local ground level, said edge restraint means serving to accommodate the horizontal forces and maintain the paving surface means in position, and including:

a substantially vertical strip restraining member for defining a boundary around said paving surface means, said substantially vertical strip restraining member being flexibly formed to accommodate for irregular shaped boundaries around paving surface means and having a first side surface for facing the paving surface means and receiving substantially horizontal forces therefrom, a second side surface for facing away from the paving surface means, and a top surface disposed below ground level, and a substantially horizontal paving surface support member force lockingly connected to the vertical strip restraining member and extending horizontally inwardly from said first side surface to an inner end disposed under the paving surface means being restrained during use thereof, whereby the downward forces on the paving surface means is transferred to said paving surface support member to clamp the same against said underlying base surface to restrain horizontal movements of the vertical strip restraining member resulting from the substantial horizontal forces.

54. A paving installation according to claim 53, wherein said vertical strip restraining member and said support member are formed as a unitary one-piece construction.

55. A paving installation according to claim 54, further comprising a substantially horizontal extension member force lockingly connected to and extending horizontally outwardly from said second side surface to an outer end, said horizontal extension member being formed together with the one-piece construction.

56. A paving installation according to claim 55, wherein the horizontal distance between the inner edge of the paving surface support member and the vertical strip restraining member is at least half as great as the distance between the outer end of the horizontal extension member and the vertical strip restraining member.

57. A paving installation according to claim 53, wherein at least a portion of the under surface of the horizontal paving surface support member is provided with rib means for limiting lateral slippage on the base surface.

58. A paving installation according to claim 53, wherein holes are provided in the horizontal paving surface support member for accommodating anchoring spikes.

59. A paving installation according to claim 53, wherein the horizontal paving surface support member is configured to accommodate anchoring spikes therethrough.

60. A paving installation according to claim 55, wherein holes are provided in the horizontal extension member for accommodating anchoring spikes.

61. A paving installation according to claim 54, wherein the horizontal extension member is configured to accommodate anchoring spikes therethrough.

62. A paving installation according to claim 60, wherein holes are provided in the horizontal paving surface support member for accommodating anchoring spikes.

63. A paving installation according to claim 62, wherein the holes in the horizontal extension member are offset in the longitudinal direction of the vertical strip restraining member with respect to the holes in the paving surface support member.

64. A paving installation according to claim 55, wherein the vertical strip restraining member, the horizontal extension member, and the horizontal paving surface support member are formed together as a unitary plastic piece.

65. A paving installation according to claim 64, wherein said unitary plastic piece is formed as an extruded plastic piece with a substantially constant cross section.

66. A paving installation according to claim 65, wherein at least a portion of the underside of the horizontal extension member and the horizontal paving surface support member are provided with longitudinally extending ribs for engaging downwardly in the base surface to limit the lateral sliding movement of the vertical strip restraining member.

67. A paving installation according to claim 66, wherein said ribs include a plurality of ribs in each of the horizontal paving surface support member and the horizontal extension member.

68. A paving installation according to claim 66, wherein the ribs are formed together with the unitary plastic piece.

69. A paving installation according to claim 65, wherein said ribs are also formed as continuous longitudinally extending protrusions at the underside of the restraint edging member.

70. A paving installation according to claim 53, wherein said horizontal paving surface support member is wider than the height of said vertical strip restraining member.

71. A paving installation according to claim 53, wherein said horizontal paving surface support member is integral with said vertical strip restraining member and extends at least 1" inwardly from a lower part of said first surface.

72. A paving installation according to claim 53, wherein said horizontal paving surface support member is integral with said vertical strip restraining member and extends at least 3" inwardly from said lower part of said first surface.

73. A paving installation according to claim 67, wherein said horizontal paving surface support member is wider than the height of said vertical strip restraining member.

74. A paving installation according to claim 73, wherein at least one of said ribs are provided in each of said horizontal extension member and said horizontal paving units support member.

75. A paving installation according to claim 53, wherein the vertical strip support member and the horizontal paving surface support member are formed together as a unitary piece each having a length of more than two feet.

76. A paving installation according to claim 75, wherein said unitary piece is a plastic piece.

77. A paving installation according to claim 76, wherein said unitary plastic piece is formed as an extruded piece with a substantially constant cross-section.

78. A paving installation according to claim 76, wherein said unitary plastic piece is formed as an injection molded piece.

79. A paving installation according to claim 76, wherein said unitary plastic piece is formed as a blow molded piece.

80. A paving installation according to claim 53, wherein said horizontal paving surface support member includes a plurality of spaced apart horizontally extending paving surface support parts integrally connected to the lower edge of the vertical restraint member.

81. A paving installation according to claim 80, wherein the spaced apart paving surface support parts are connected at their most inward ends by a paving surface support web member extending parallel to the vertical restraint member.

82. A paving installation according to claim 54, wherein the horizontal extension member includes a plurality of spaced apart horizontally extending extension parts integrally connected to the vertical restraint member.

83. A paving installation according to claim 82, wherein the spaced apart extension parts are connected at their most outward ends by an extension web member extending parallel to the vertical restraint member.

84. A paving installation according to claim 82, wherein the horizontal extension member includes a plurality of spaced apart horizontally extending extension parts integrally connected to the lower edge of the vertical restraint member.

85. A paving installation according to claim 84, wherein the spaced apart paving unit support parts are connected at their most inward ends by paving surface support webs extending parallel to the vertical restraint member.

86. A paving installation according to claim 85, wherein the spaced apart extension parts are connected at their most outward ends by extension webs extending parallel to the vertical restraint member.

* * * * *